US007819950B2

(12) United States Patent
Stinessen et al.

(10) Patent No.: US 7,819,950 B2
(45) Date of Patent: Oct. 26, 2010

(54) SUBSEA COMPRESSION SYSTEM AND METHOD

(75) Inventors: Kjell Olav Stinessen, Oslo (NO); Håkon Skofteland, Sandvika (NO)

(73) Assignee: Kvaerner Oilfield Products A.S., Lysaker (NO)

( * ) Notice: Subject to any disclaimer, the term of this patent is extended or adjusted under 35 U.S.C. 154(b) by 1178 days.

(21) Appl. No.: 10/571,251

(22) PCT Filed: Sep. 9, 2004

(86) PCT No.: PCT/NO2004/000268

§ 371 (c)(1),
(2), (4) Date: May 10, 2006

(87) PCT Pub. No.: WO2005/026497

PCT Pub. Date: Mar. 24, 2005

(65) Prior Publication Data

US 2007/0029091 A1 Feb. 8, 2007

(30) Foreign Application Priority Data

Sep. 12, 2003 (NO) ..... 20034055

(51) Int. Cl.
*B01D 47/00* (2006.01)

(52) U.S. Cl. ..... 95/153; 95/229; 96/242; 96/235; 166/357; 585/15

(58) Field of Classification Search ..... 166/357; 96/193, 242, 235; 55/15, 315; 95/266, 288, 95/153, 286, 229, 227; 585/15
See application file for complete search history.

(56) References Cited

U.S. PATENT DOCUMENTS

| | | | | | |
|---|---|---|---|---|---|
| 3,292,846 | A | * | 12/1966 | Harper et al. | 415/1 |
| 3,384,169 | A | * | 5/1968 | Leonard | 166/357 |
| 3,989,487 | A | * | 11/1976 | Peterson | 96/242 |
| 4,116,821 | A | * | 9/1978 | Peiser | 208/361 |
| 4,896,725 | A | * | 1/1990 | Parker et al. | 166/267 |
| 4,921,399 | A | * | 5/1990 | Lew | 415/27 |
| 5,031,411 | A | * | 7/1991 | Gehring et al. | 62/93 |
| 5,044,440 | A | * | 9/1991 | Stinessen et al. | 166/344 |

(Continued)

FOREIGN PATENT DOCUMENTS

RU 2 171 132 7/2001

(Continued)

*Primary Examiner*—Duane Smith
*Assistant Examiner*—Ives Wu
(74) *Attorney, Agent, or Firm*—Young & Thompson

(57) ABSTRACT

A subsea compression system and method wherein a wellstream fluid is flowed through a flow line (12) from a reservoir (10) and into a separation vessel (16) for subsequent compression in a compressor (18; 18', 18") prior to export of gas. A recycle line (24; 24', 24") is fluidly connected at a first end to the compressed wellstream at the outlet side of the compressor (18; 18', 18") and at a second end to the wellstream at a location between the separation vessel (16) and the inlet side of the compressor (18; 18', 18"), the recycle line being capable of controllably (32) feeding fluid due to surge back to the compressor inlet side and avoiding the need to feed the fluid into the separation vessel, because the re-circulated gas is dry both due to having been separated at seawater temperature, and then being heated during recirculation.

30 Claims, 7 Drawing Sheets

U.S. PATENT DOCUMENTS

| | | | | | |
|---|---|---|---|---|---|
| 5,154,741 | A * | 10/1992 | da Costa Filho | ..... | 96/157 |
| 5,382,141 | A | 1/1995 | Stinessen | | |
| 5,398,762 | A * | 3/1995 | Stinessen | ..... | 166/356 |
| 6,094,937 | A | 8/2000 | Paurola et al. | | |
| 6,502,635 | B1 * | 1/2003 | Underdown et al. | ..... | 166/267 |
| 6,672,387 | B2 * | 1/2004 | Brady et al. | ..... | 166/266 |

FOREIGN PATENT DOCUMENTS

| | | | |
|---|---|---|---|
| WO | WO 8912728 | | 12/1989 |
| WO | WO 01/74473 | | 10/2001 |
| WO | WO 03/033870 | A1 * | 4/2003 |
| WO | WO 03033870 | | 4/2003 |

* cited by examiner

SUBSEA COMPRESSION SYSTEM AND METHOD

BACKGROUND OF THE INVENTION

The present invention relates to subsea gas compression.

More specifically the invention relates to a system and method for cooling a well stream down to, or in the region of, the temperature of the surrounding seawater, prior to the well stream gas entering the scrubber. More specifically, the invention relates to a system and method wherein a well stream fluid is flowed through a flow line from a reservoir and into a separation vessel for subsequent compression of the separated gas stream in a compressor prior to export of gas.

DESCRIPTION OF THE RELATED ART

It could seem desirable to endeavour to keep the separation temperature in the separator/scrubber of a subsea compression station and the temperature of the gas leaving the scrubber, above hydrate temperature, approximately 25° C. or more, to avoid hydrate formation. Typical for topsides and onshore is to insulate and trace heat the pipe between the scrubber and the compressor inlet to keep it above hydrate temperature.

Separation at 25° C. or more requires more compression power, approximately 10%, compared to separation and compression at sea water temperature, which at deep water, typically 200 m or more, is close to constant. Typically the temperature in deep waters can be in the range of −2 to +4° C., and almost constant for a given location. Compared to the onshore and topside climatic conditions, which may vary from e.g. −30° C. to +30° C. over the seasons, the subsea conditions have the significant advantage of constant temperature.

The well stream from subsea oil and gas wells are inhibited against hydrates by injection of MEG, DEG, TEG, methanol or other chemicals. The only concern about potential hydrate formation in a subsea compression station is therefore in the gas from leaving the separation interface in the scrubber to the gas is commingled with the liquid phase of the well stream downstream the station.

This concern is however eliminated or reduced to insignificant if the separation/scrubbing is carried out at or close to seawater temperature. The reason for this is that the temperature of the separated gas can not become colder than the surrounding seawater, and hence no water can condensate out from the gas and form free water. Free water is the prerequisite for hydrate formation, which is simply that the liquid water freezes to ice at temperatures above 0° C. due to influence of light hydrocarbons.

It can be remarked that the gas temperature between the scrubber outlet and the compressor inlet may be slightly reduced by some throttling, typically through an orifice, nozzle or V-cone meter for flow metering. Such throttling will however be modest, typically a fraction of 1 bar. Calculations have shown that the pressure reduction of the gas counteracts the condensation of water caused by the temperature lowering, and that condensation of hydrocarbons is negligible. Additionally the pipe wall will have seawater temperature, and therefore act as a natural trace heating. The apparent paradox is therefore that hydrate control is achieved by performing the scrubbing at sea water temperature.

Referring to FIG. 1, a prior art subsea compressor station, where separation is performed at temperatures above seawater temperature, is schematically illustrated. Well stream fluids (for example from a subsea template or manifold) are fed via the flow line 12 into a separation vessel 16. Following separation, gas (possibly also containing carry-over of some liquid) is flowed into the compressor module 19, where it is compressed by the compressor 18 (driven by the drive unit 20) before it is fed into the line as illustrated. The re-cycle line 23 feeds any gas (e.g. due to surges) in the system, back to the inlet side of the separation vessel. This anti-surge line conventionally comprises a re-cycle cooler 25 as illustrated.

There are several disadvantages by subsea separation at higher temperatures than seawater temperatures:

- The necessary compression power will always be higher compared to compression at lowest achievable temperature, i.e. seawater temperature.
- Remedies for counteracting hydrate formation in the gas after separation in the scrubber will be required, either by always keeping the gas temperature in the compressor station above approx. 25° C., or by injection of hydrate inhibitor.
- It will be necessary to route the anti-surge line to upstream the scrubber, because the gas is not dry.

On the other hand, separation at ambient seawater temperature, e.g. −2° C. to +4° C., ensures that the gas is dry from when it leaves the separation interface in the scrubber throughout the compression system, in the anti-surge re-cycle line and in the gas discharge line. This simply because the gas, provided no significant throttling in the gas line, can not be cooled down to a lower temperature than the temperature at which it has been separated, i.e. the seawater temperature, and hence no free water can be condensed out of the gas stream. In this case the gas pipeline that has a temperature like the seawater temperature, will act like a heater on the gas (i.e. no heat transfer from the fluid (gas stream) to water surrounding the pipeline) with a slightly lower temperature just after the throttling device. Through the compressor, the gas will be heated, and therefore removes from the dew-point. After compression the gas can either be commingled with the liquid phase, or it can be transported in a separate gas line to shore or to a distant receiver platform. Again, there will be no condensation of liquid water in this gas line, and hence no need for hydrate inhibition, provided that it does not go through areas where the seawater temperature is lower than the scrubber temperature.

SUMMARY OF THE INVENTION

The invention comprises a subsea compression system wherein a well stream fluid is flowed through a flow line from a reservoir, said well stream fluid having a temperature in the region of the temperature of the water surrounding the flow line when the well stream fluid is flowed into a separation vessel for subsequent compression of the gas stream in a compressor prior to export of gas. In one embodiment, the subsea compression system is characterised by a re-cycle line being connected at a first end to the compressed gas stream at the outlet side of the compressor and at a second end to the gas stream at a location between the separation vessel and the inlet side of the compressor. In another embodiment, the subsea compression is characterised by a re-cycle line connected at a first end to the compressed gas stream at the outlet side of the compressor and at a second end to the well stream at a location upstream of the separation vessel.

Thus the re-cycle line being capable of controllably feeding fluid (due to surge or other reasons for re-cycle) back to the compressor inlet side and avoiding the need to feed said fluid into the separation vessel, because the re-circulated gas is dry both due to having been separated at seawater temperature, and then being heated during recirculation.

In one aspect of the invention, a cooler is fluidly connected to said re-cycle line.

The flow line may have a distance which is sufficiently long to ensure that said well stream is cooled to a temperature which equal to, or in the region of, the temperature of the seawater surrounding the flow line.

A cooler may optionally be fluidly connected to said flow line to ensure cooling down to seawater temperature. The flow line may have a distance of between 0.5 km and 5 km.

In cases of oil production, the major part of the well stream mass flow is oil (together with more or less liquid water). In such cases, cooling of the whole well stream down to seawater temperature before separation, can be impractical or even not desirable because the low temperature opposes good liquid/gas separation. A better method for oil production systems can therefore to cool only the separated gas after a primary oil/gas separation. The separated gas is cooled down to seawater temperature before entering a scubber inserted in the gas line between the primary scrubber and the compressor inlet (cf. Norwegian Patent No. 173 890).

The invention also comprises a method for compressing a well stream fluid at a subsea is location, wherein hydrate inhibited well stream fluid having a temperature in the region of the temperature of the water surrounding the flow line is flowed in a flow line and into a separation vessel for subsequent compression of the separated gas stream in a compressor prior to export of compressed gas. In one embodiment, the invented method is characterised by feeding compressed fluid due to surge or re-cycle, back to a location between said separation vessel and the inlet side of the compressor. In a second embodiment, the invented method is characterised by feeding compressed fluid due to surge or re-cycle, back to a location upstream of said separation vessel.

To obtain an additional safeguard against condensation in the compression system after the scrubber, some heating of the piping may be included. The well stream gas leaving the scrubber is close to seawater ambient temperature and close to heat transfer equilibrium. Only a small amount of heating of the piping will give a safety margin against condensation in the compression system downstream the scrubber. The heating may be achieved by some electrical heating and/or process heating. Process heat may be available from typically motor coolers and process coolers Following separation in the separation vessel 16, the gas stream may be fed into a plurality of compressors connected in parallel, each compressor comprising separate re-cycle lines being fluidly connected at a respective first end to the compressed gas stream at the outlet side of the respective compressor and at a respective second end to the gas stream at a location between the separation vessel and the inlet side of the respective compressor. This will allow for isolation valves fitted between the separator and each of the compressors, thus allowing isolation and shut-down and intervention of each compressor independently of other compressors.

A cooler may be fluidly connected to the compressed gas stream at a location between the re-cycle line take-off point and the export line and that a restrictor with a scrubber is fluidly connected to the compressed gas stream between the cooler and any export line, whereby the compressed gas can be dew-point controlled prior to export.

The invention also comprises a method for compressing a well stream fluid at a subsea location, wherein hydrate inhibited well stream fluid is flowed in a flow line into a separation vessel for subsequent compression of the gas stream in a compressor prior to export of compressed gas, characterised by feeding compressed fluid due to surge or re-cycle, back to a location between said separation vessel and the inlet side of the compressor.

The compressed fluid being recirculated due to said surge, may be heat exchanging in order to cool said fluid.

In the compression system, a scrubber initially removes virtually all liquid hydrocarbons and liquid water before the gas is fed into the compressor. It is a basic requirement that the well stream is inhibited against the formation of hydrates (by e.g. MEG or methanol injection) at a location upstream of the compression system, and before the well stream is being cooled down to a temperature at which hydrate formation may occur (typically below 25° C.). This also ensures that hydrates do not form along the flow line to the distant onshore or offshore receiving facility.

The compressor module 18 of the system can either have oil lubricated bearings and a gear, or—and preferably—magnetic bearings and high speed motor, similar to the disclosure of Norwegian Patent Application No. 20031587.

Magnetic bearings, i.e. no oil lubrication system, allows the shortest possible start up time of a subsea compressor, because there is no lube oil that needs to be heated up to lube oil running temperature. Further, because the temperature of the inlet gas from the scrubber is at or close to seawater temperature, the recirculation of gas through the recirculation line (anti-surge line) should be kept to a minimum, i.e. only to bring the compressor discharge pressure up to required level to open the compressor discharge valve. Longer recirculation time than this, removes the temperature of the re-circulated gas from the temperature of the gas in the scrubber, which is not beneficial due to the resulting density difference. This is clearly different from start up of onshore and topside compressors, where the gas to be routed into the compressor from the scrubber end inlet line can be e.g. 30° C. on a hot day.

BRIEF DESCRIPTION OF THE DRAWINGS

An embodiment of the present invention will now be described in more detail, with reference to the accompanying drawings, where like parts have been given like reference numbers.

DESCRIPTION OF THE PREFERRED EMBODIMENT

Figure 1:
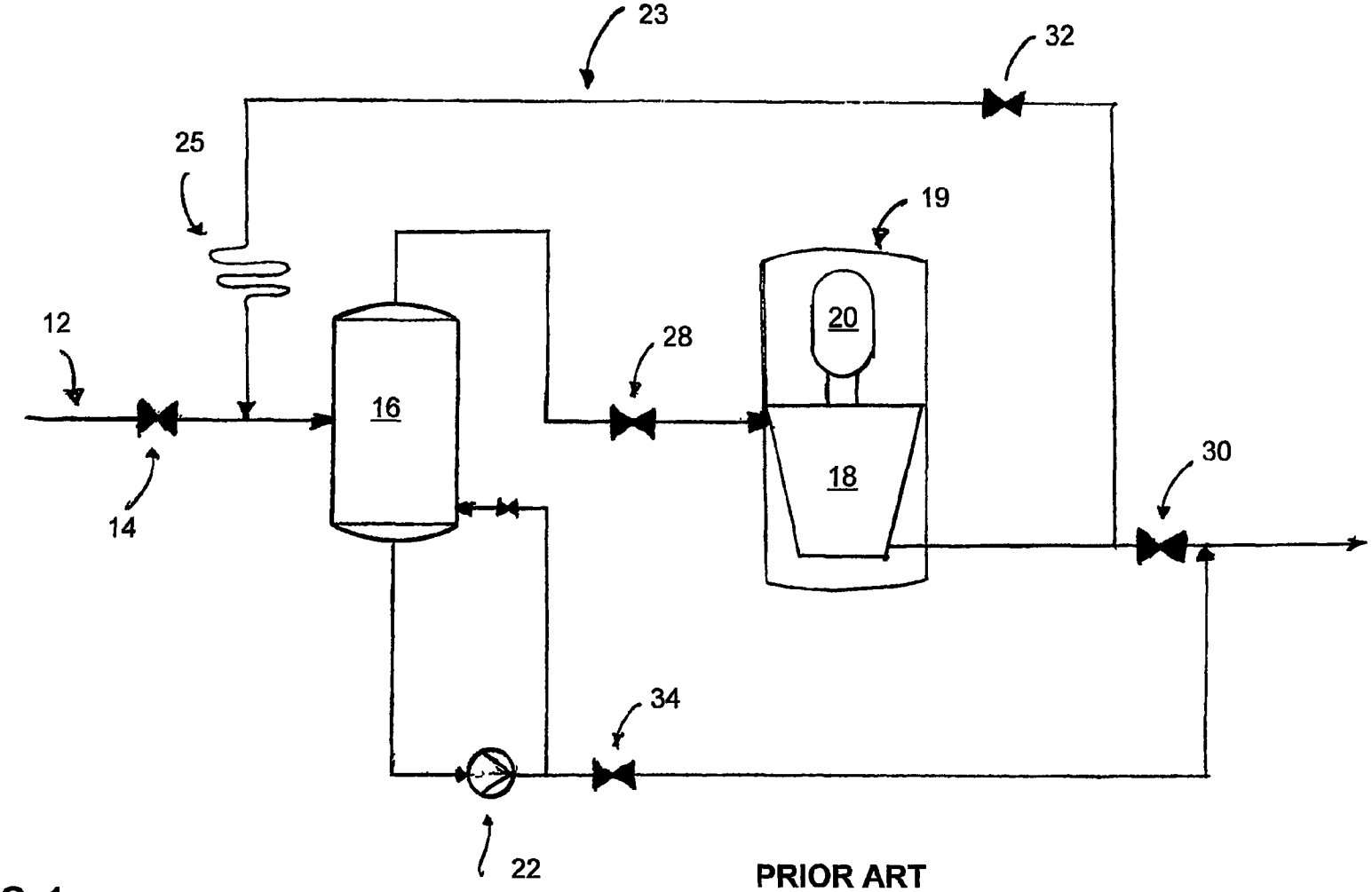
PRIOR ART FIG. 1
FIG. 1 is a schematic of a prior art subsea compression system (described above)
Figure 2:
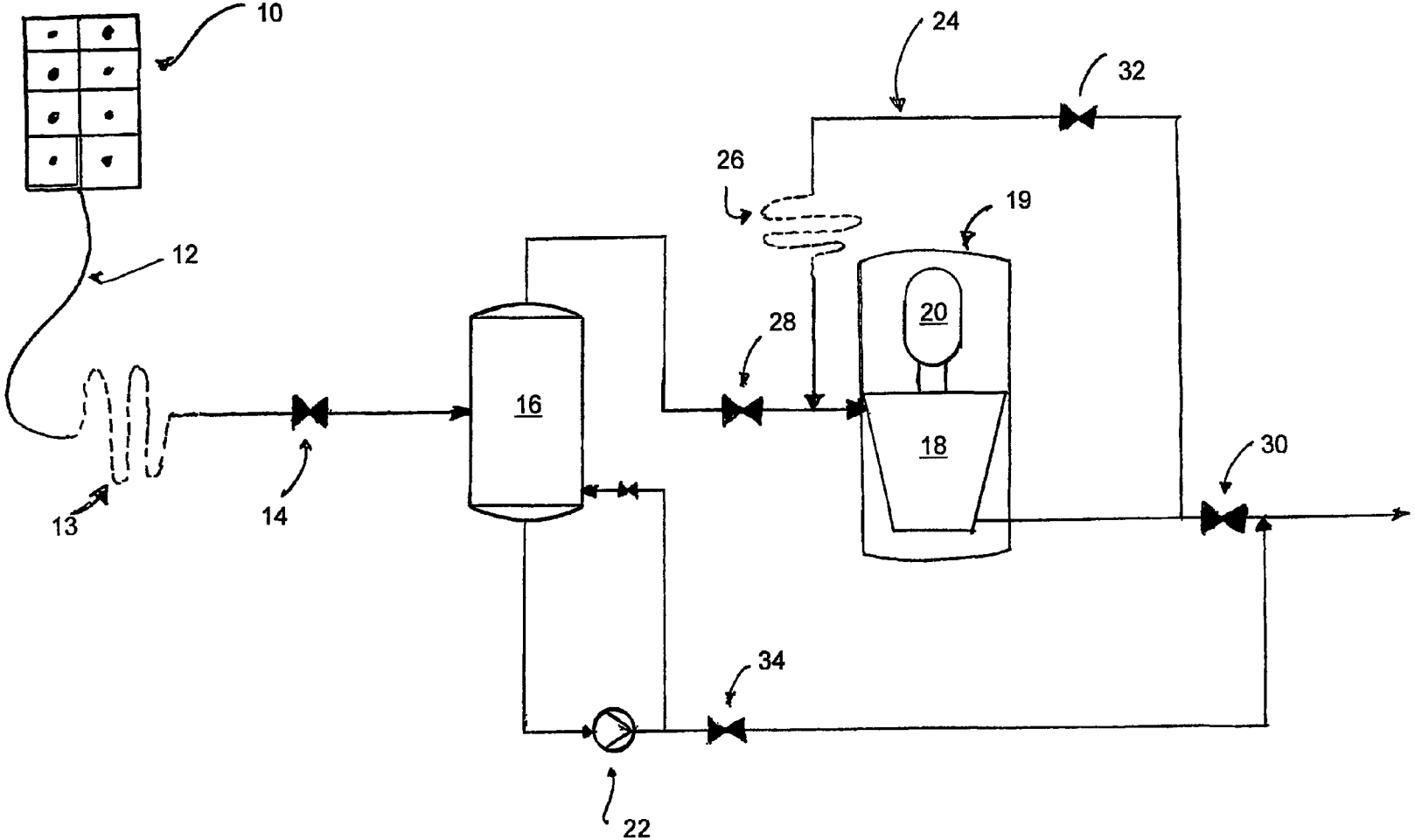
FIG. 2 is a schematic of one embodiment the system according to the invention.

Referring to FIG. 2, which illustrates one aspect of the invention, a subsea template or manifold 10 is schematically illustrated. The manifold may comprise a number of slots as well as a hydrate inhibitor injection unit, for injecting e.g. MEG or methanol into the well stream. The well stream is flowed in the flow line 12 to the subsea compression system.

It is a basic requirement for the invention that the well stream is inhibited against the formation of hydrates as described, at a location upstream of the compression system, and before the well stream is being cooled down to a temperature at which hydrate formation may occur (typically about 25° C.). The injection of hydrate inhibitants also ensures that hydrates do not form along the flow lines to the distant onshore or offshore receiving facility.

By virtue of the long flow line 12 (e.g. 2 to 3 km) the well stream is cooled to a temperature that is equal to, or in the region of, the surrounding sea water temperature, prior to entering the scrubber 16. A cooler 13 may as an option be included, if the length of the flow line is not sufficient to ensuring the required cooling. By reducing the temperature in this manner, the required power for compression is reduced to a minimum, and an effective suppression of the risk of hydrate formation in the gas between the inlet and the outlet of the compression system is achieved. Hence the virtually infinite cooling capacity of the ocean is utilized in a deliberate manner to cool the well stream down to (or close to) the ambient sea temperature, which at deep waters is nearly constant (typically in the range of −2° C. to +4° C.).

Figure 3:
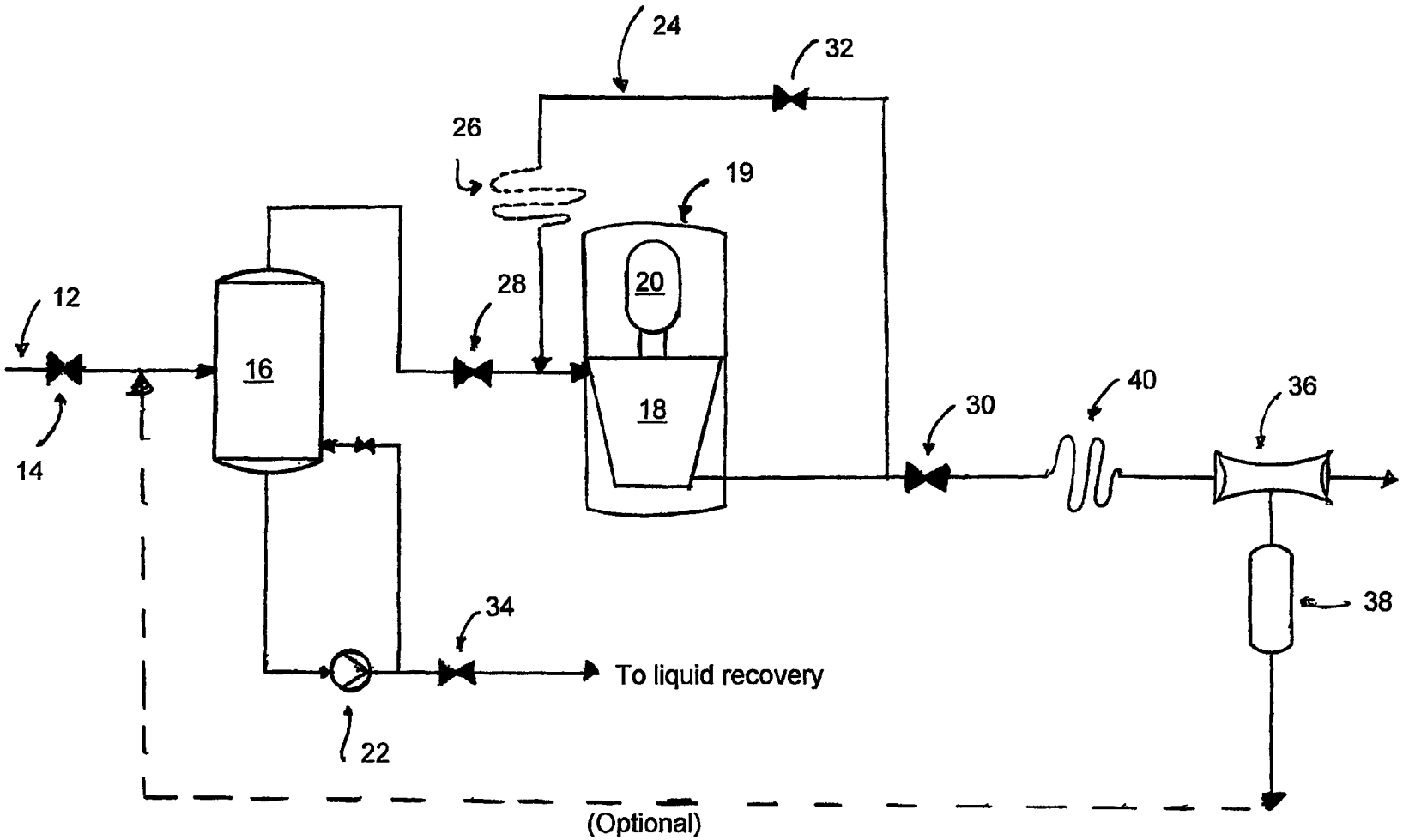
FIG. 3 is a schematic of the system of FIG. 2, but with a cooling and liquid removal unit at the compression system outlet end.
Figure 4:
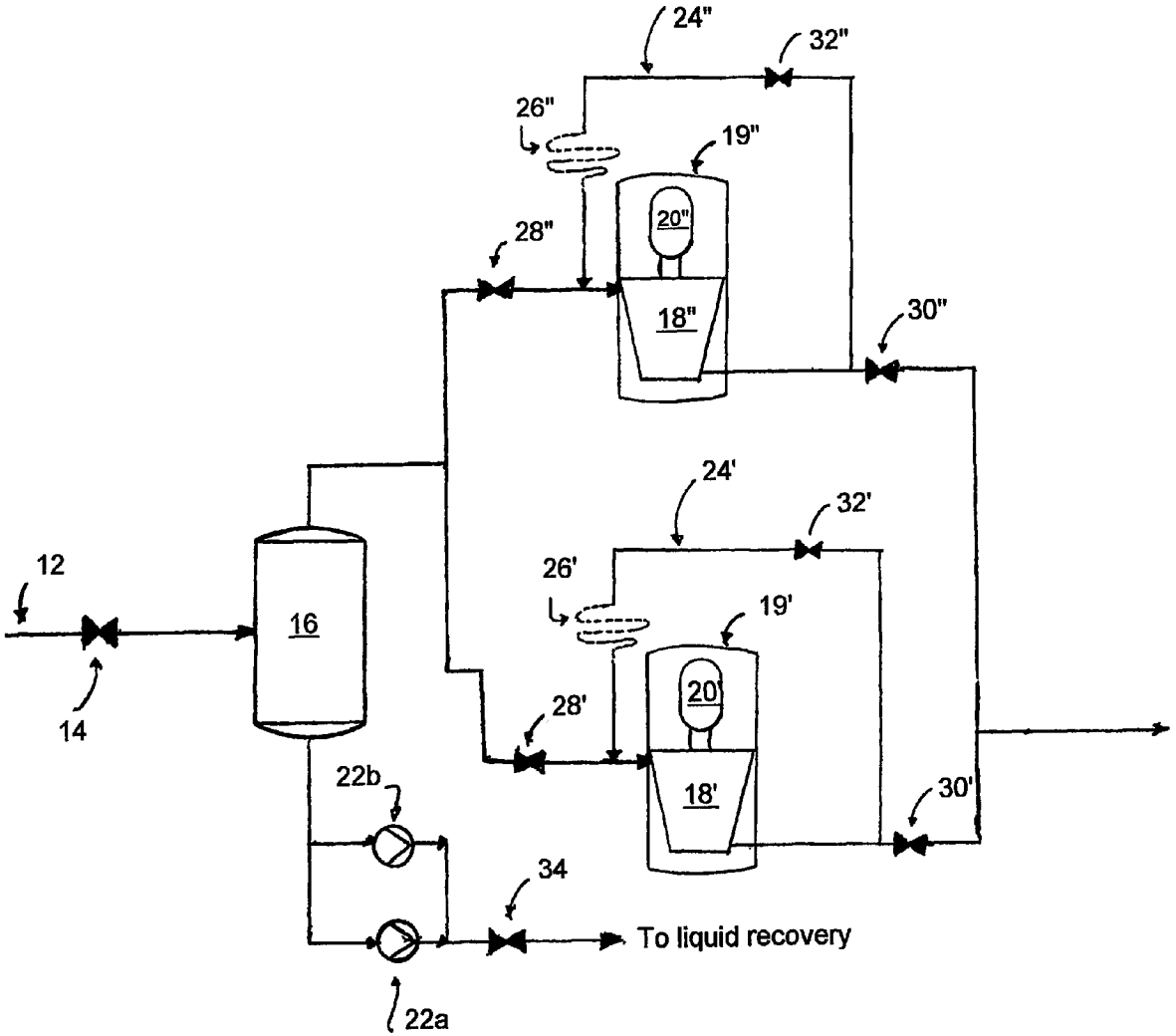
FIG. 4 is a schematic of a second embodiment of the system according to the invention.

Returning to FIG. 2, the cooled well stream is fed into a separation vessel or scrubber 16, where it is separated in a normal fashion. Due to the aforementioned temperature control, the gas can not form hydrate after separation. By having a gas stream temperature, which is close to the surrounding seawater temperature being fed into the compressor, that is the minimum attainable temperature, a much lesser power consumption is achieved compared to the prior art compression systems. The invention furthermore allows the recirculation line for the anti-surge system to be routed to a location downstream of the separation vessel and upstream of the compressor, as shown in FIGS. 2, 3, and 4. The recirculation line 24 with an optional cooler 26 is in FIG. 2 shown as being routed to a point between the separator and the compressor module.

With the invented system, having the re-cycle line 24; 24', 24" fluidly connected at a first end to the compressed gas stream at the outlet side of the compressor 18; 18', 18" and at a second end to the gas stream at a location between the separation vessel 16 and the inlet side of the compressor 18; 18', 18", the re-cycle line is capable of controllably feeding fluid due to surge back to the compressor inlet side and avoiding the need to feed said fluid into the separation vessel, because the re-circulated gas is dry both due to having been separated at seawater temperature, and then being heated during recirculation.

A further advantage of the invention is illustrated in FIG. 4, which shows two compressors installed in parallel with only one separation vessel. Each compressor comprises its own recirculation line 24', 24", with respectively associated valves 32', 32" and (optional) heat exchangers 26', 26".

Following separation in the separation vessel 16, the gas stream may be fed into a plurality of compressors connected in parallel, each compressor comprising separate re-cycle lines being fluidly connected at a respective first end to the compressed gas stream at the outlet side of the respective compressor and at a respective second end to the gas stream at a location between the separation vessel and the inlet side of the respective compressor. This will allow for isolation valves located between the separator and each of the compressors, thus allowing isolation and shut-down and intervention of each compressor independently of other compressors.

The invention eliminates the need for a specific device to control the heat exchange in order to keep a defined temperature to the separation vessel inlet, as the seawater defines the lowest and the fixed temperature.

The invention also facilitates easier maintenance of the system, in that only one separation vessel is required, and that separate compressor units (as shown in FIG. 4) may be pulled out and replaced individually. Due to the simplified anti-surge line, a quicker response compared to the prior art is also facilitated.

A number of valves 14, 34, 30, 32, 28 are shown for illustration purposes. A number of sensors have, however, been omitted for the sake of clarity of illustration. The person skilled in the art will understand the need for relevant valves, sensors, etc.

Cooling the inlet well stream down to ambient seawater temperature of typically −2° C. to +4° C. gives much lower compressor discharge temperatures compared to maintaining the inlet well stream gas temperatures above hydrate formation temperatures of typically +30° C. to +40° C. The compressor has a maximum discharge operating temperature of typically +150° C. to +200° C. and the subsea export pipelines typically has maximum operating temperatures of +70° C. to +120° C. Therefore, due to the lower inlet temperature, the invention allows for higher pressure ratio across each compressor and thus higher temperature increase through the compressor. The invention also reduces the amount of compressor discharge cooling required for the discharge gas due to temperature limitations in downstream equipment and pipelines.

Turning now to FIG. 3, the hydrate inhibited and cooled well stream is flowed into the compression system via the flow line 12 as described above, and proceeds through the system according to the invention. Shown at the right hand side of FIG. 4, the compressed gas is flowed through a heat exchanger (cooler or equivalent) 40 to cool down preferably to sea water temperature and a restriction 36 where the temperature of the gas is further reduced by throttling through a restriction; the more throttling the more temperature reduction. By spending sufficient compression power followed by sufficient pressure reduction, the temperature in the gas can be lowered to the required level for necessary dew-point control, provided efficient removal of liquid in the scrubber 38, for injection into (e.g.) an export or trunk line.

In the invented system, the well stream fluid is flowed through the flow line 12 from a source (e.g. a subsea template) 10 and into the separation vessel 16, where it is subsequently compressed by the compressor 18; 18', 18" prior to being exported (to e.g. a trunk line, export line or other facility). The re-cycle line 24; 24', 24" is fluidly connected at a first end to the compressed gas stream at the outlet side of the compressor 18; 18', 18" and at a second end to the gas stream at a location between the separation vessel 16 and the inlet side of the compressor 18; 18', 18". The re-cycle line is capable (e.g. by means of valve 32) of controllably feeding some of the fluid (which is due to surge or re-cycle) back to the compressor inlet side and avoiding the need to feed said fluid into the separation vessel, because the re-circulated gas is dry both due to having been separated at seawater temperature, and then being heated during recirculation.

If necessary (as discussed above), a cooler 26; 26', 26" may be fluidly connected to the re-cycle line 24; 24', 24".

In order to achieving sufficient cooling of the well stream (equal to, or in the region of, the temperature of the seawater surrounding the flow line), the flow line 12 may have a length of between 0.5 km and (e.g.) 5 km. Additionally, a cooler 13 may be fluidly connected to the flow line.

In one embodiment of the invention, the gas stream, following separation in the separation vessel 16, is fed into a plurality of compressors 18', 18" connected in parallel. As shown in FIG. 4, each compressor comprises separate re-cycle lines 24', 24" fluidly connected at a respective first end to the compressed gas stream at the outlet side of the respective compressor 18', 18" and at a respective second end to the gas stream at a location between the separation vessel 16 and the inlet side of the respective compressor 18', 18".

A cooler 40 may in one embodiment be fluidly connected to the compressed gas stream at a location between the re-cycle line 24 take-off point and the export line, and a restrictor 36 with a scrubber 38 may be fluidly connected to the compressed gas stream between the cooler 40 and any export line. Thereby the compressed gas can be dew-point controlled prior to export.

In the invented method, where hydrate inhibited well stream fluid is flowed in a flow line 12 into a separation vessel 16 for subsequent compression in a compressor 18; 18', 18" prior to export of compressed gas, compressed fluid due to surge or re-cycle, is fed back to a location between said separation vessel 16 and the inlet side of the compressor 18; 18', 18".

If necessary, the compressed fluid being fed due to said surge or re-cycle, is heat exchanged (cooled) prior to entering the compressor.

In the method, the well stream is cooled to a temperature which is equal to, or in the region of, the temperature of the seawater surrounding the flow line 12, prior to its entry into the separator 16.

Following separation, the gas stream may in one embodiment be fed into a plurality of compressors 18', 18" connected in parallel, each compressor comprising separate re-cycle lines 24', 24" being fluidly connected at a respective first end to the compressed gas stream at the outlet side of the respective compressor 18', 18" and at a respective second end to the gas stream at a location between the separation vessel 16 and the inlet side of the respective compressor 18', 18".

In one embodiment, the method comprises cooling said compressed gas stream at a location between the re-cycle line 24 take-off point and the export line and dew-point controlling said compressed gas prior to export by means of a restrictor 36 with a scrubber 38 fluidly connected to the compressed gas stream between the cooler 40 and any export line.

If the temperature $t_{rec}$ of the re-cycled gas being fed through the recirculation line 24; 24', 24" is equal or close to the temperature $t_{amb}$ of the water surrounding the recirculation line, then it is possible to route the re-cycled gas to a point upstream of the separator 16 and still achieve the objects of the invention. This embodiment is shown in FIGS. 5, 6 and 7, where the recirculation line 24; 24', 24" is fluidly connected at a first end to the compressed gas stream at the outlet side of the compressor 18; 18', 18", and at a second end to the well stream flowline 12 upstream of the separator 16.

Figure 5:
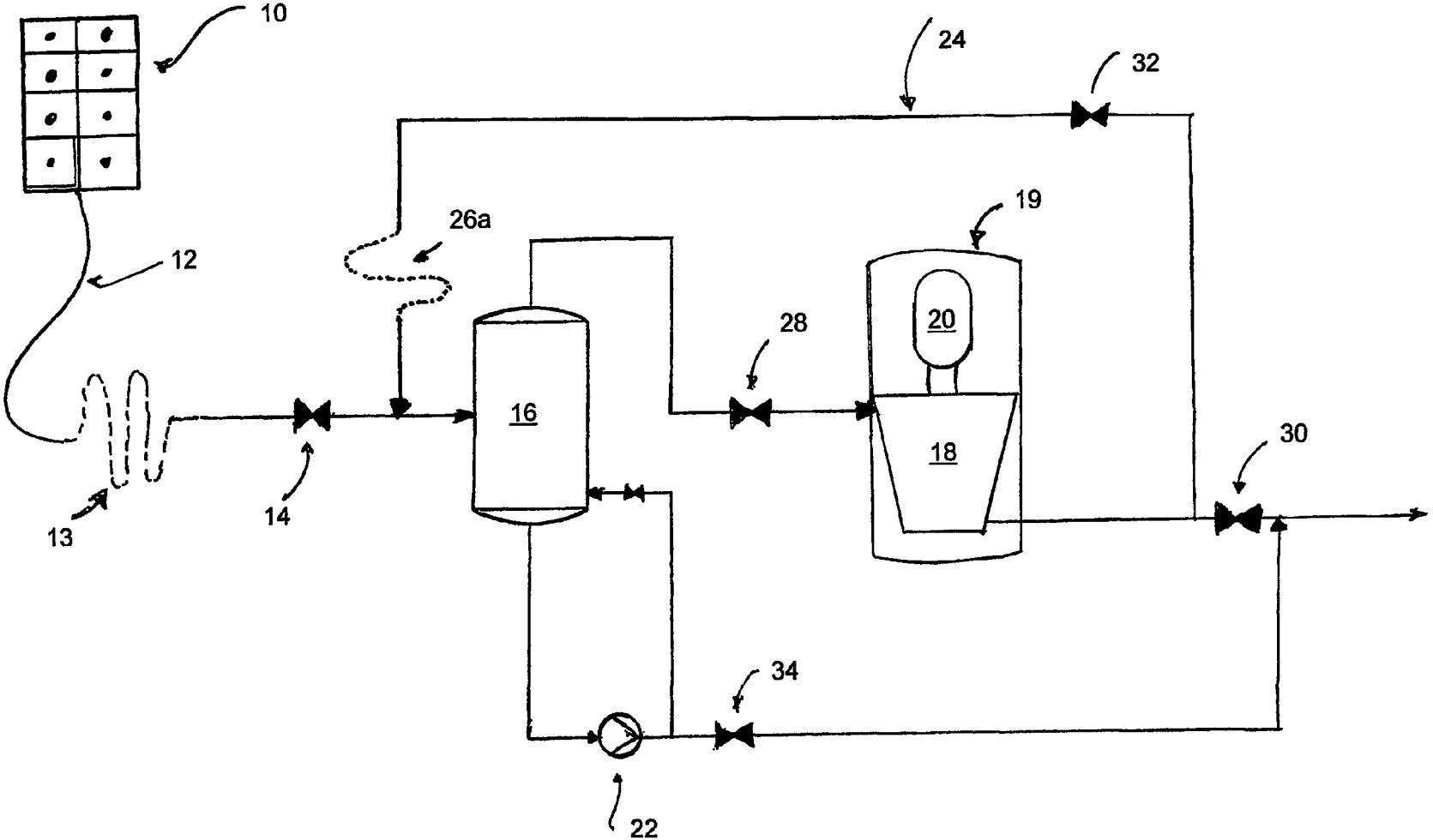
FIG. 5 is a schematic of a third embodiment of the invention.
Figure 6:
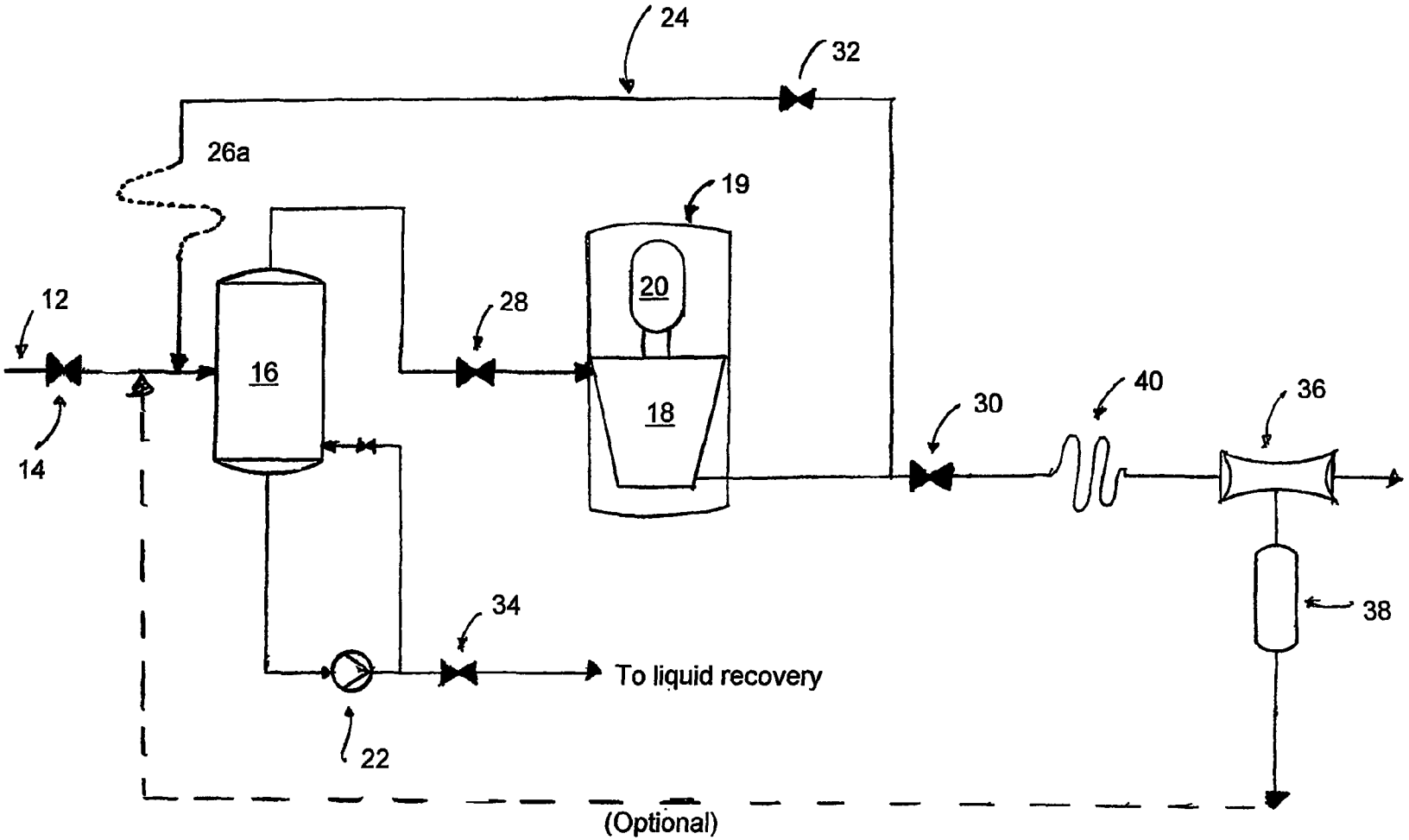
FIG. 6 is a schematic of the system of FIG. 5, but with a cooling and liquid removal unit at the compression system outlet end.
Figure 7:
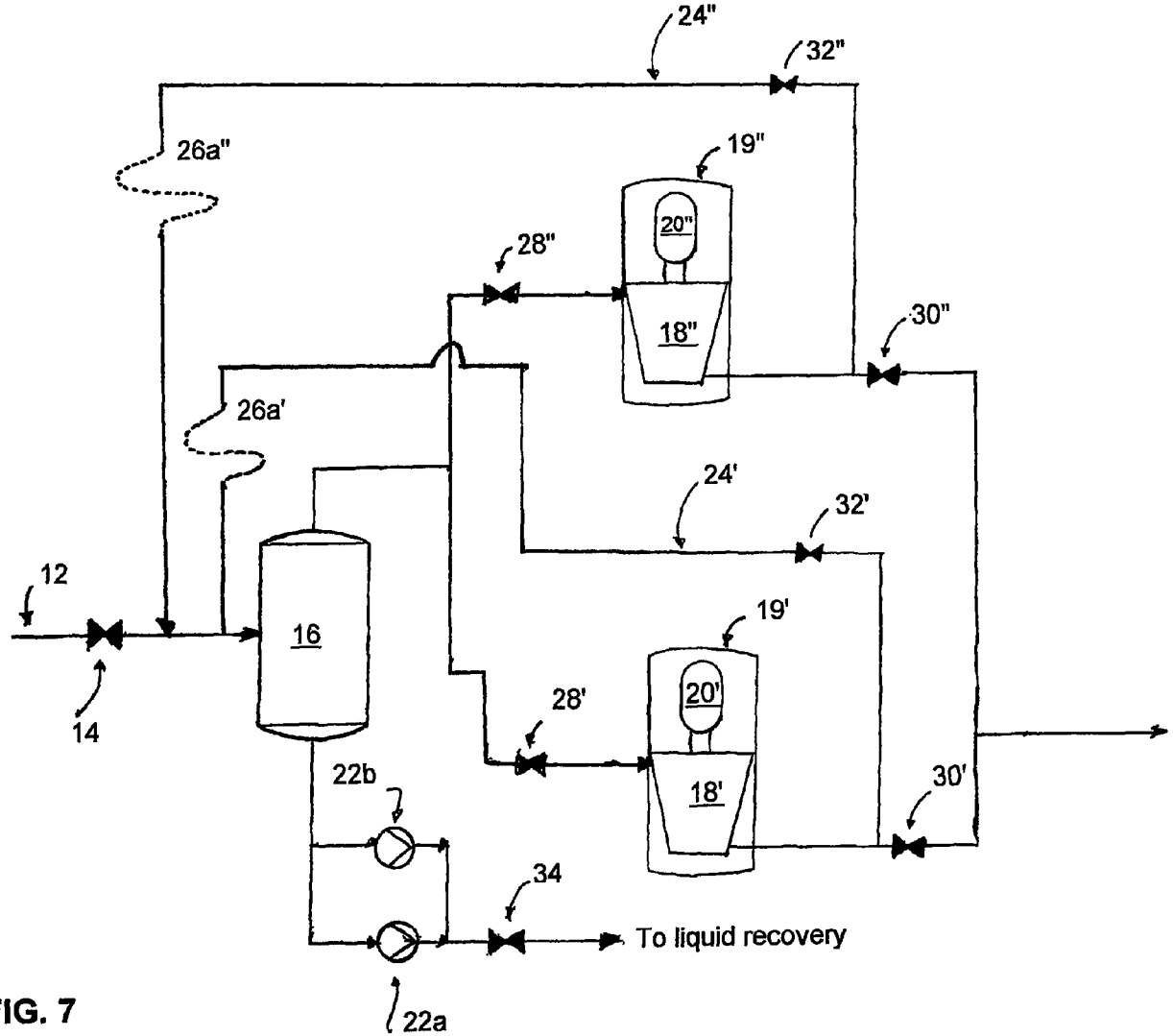
FIG. 7 is a schematic of a fourth embodiment of the invention.

FIGS. 5, 6 and 7 correspond to FIGS. 2, 3 and 4, respectively, the difference being the point to which the second end of the recirculation line is connected.

In order to ensure that $t_{rec}$ is in the region of $t_{amb}$, thus allowing a routing as shown in FIGS. 5, 6 and 7, the optional re-cycle cooler 26*a*; 26*a'*, 26*a"* may be employed to control $t_{rec}$.

LIST OF COMPONENTS

| | |
|---|---|
| 10 | Subsea template and/or manifold (comprising a number of slots and an hydrate inhibitor injection unit, injecting e.g. MEG og methanol) |

-continued

| | |
|---|---|
| 12 | Flow line(s) (quite long in order to cool the well stream, or comprising a cooler) |
| 13 | Well stream cooler (optional) |
| 14 | Valve |
| 16 | Separation vessel |
| 18 | Compressor |
| 19 | Compressor housing |
| 20 | Compressor drive unit |
| 22 | Pump(s) |
| 23 | Prior art re-cycle line |
| 24 | Re-cycle line |
| 25 | Prior art re-cycle cooler |
| 26 | Re-cycle cooler (optional) |
| 28 | Valve |
| 30 | Valve |
| 32 | Valve |
| 34 | Valve |
| 36 | Restrictor |
| 38 | Separator |
| 40 | Cooler |

The invention claimed is:

1. A subsea compression system, comprising:

a reservoir (10);

a separation vessel (16) for separating gas from a well stream fluid at ambient seawater temperature;

a flow line (12) connecting the reservoir (10) to the separation vessel (16) and surrounded by seawater;

the well stream fluid flowing through the flow line (12) from the reservoir (10) into the separation vessel (16), said flow line (12) having a length acting as a temperature control such that said well stream fluid is inhibited against hydrate formation and, based on said length, the well stream fluid is cooled to have a temperature in the region of ambient seawater temperature of the water surrounding the flow line when entering said separation vessel (16), said well stream fluid being separated in the separation vessel into a separated gas stream at the ambient seawater temperature, said separated gas stream being unable to form a hydrate;

a compressor (18; 18', 18") connected to an outlet side of the separation vessel, the compressor receiving the separated gas stream from the outlet side of the separation vessel for subsequent compression of the separated gas stream into an export compressed gas stream; and a re-cycle line (24; 24', 24") having a first inlet end and a second outlet end, the first inlet end connected to an outlet side of the compressor to received the compressed export gas stream at the outlet side of the compressor and the second outlet end connected intermediate the outlet side of the separation vessel and an inlet side of the compressor.

2. The subsea compression system of claim 1, wherein the length of the flow line is selected to provide that the temperature of the well stream fluid when entering said separation vessel (16) is in the range of −2° C. to +4° C.

3. The subsea compression system of claim 1, further comprising a cooler (26; 26', 26") being fluidly connected to said re-cycle line, and wherein, said system comprises plural of said compressor and plural of said re-cycle line, the plural compressors are connected in parallel with each other, each compressor comprises a separate one of said re-cycle lines (24', 24") being fluidly connected at a respective first end to the compressed gas stream at the outlet side of the respective compressor (18', 18") and at a respective second end to the gas stream at a location between the separation vessel (16) and the inlet side of the respective compressor (18', 18"), and the separated gas stream is fed into the plural compressors.

4. A subsea compression system, comprising:

a reservoir (10);

a separation vessel (16);

a flow line (12) connecting the reservoir (10) to the separation vessel (16);

a coolant surrounding the flow line;

a well stream fluid flowing through the flow line (12) from the reservoir (10) into a separation vessel (16), said well stream fluid being separated in the separation vessel into a separated gas stream, said well stream fluid being inhibited against hydrate formation and being cooled by said coolant to a temperature which does not lead to condensation of the separated gas stream at an outlet side of the separation vessel;

a compressor (18; 18', 18") connected to an outlet side of the separation vessel, the compressor receiving the separated gas stream from the outlet side of the separation vessel for subsequent compression of the separated gas stream into a compressed export gas stream; and a re-cycle line (24; 24', 24") having a first inlet end and a second outlet end, the first inlet end connected to an outlet side of the compressor to received the compressed export gas stream at the outlet side of the compressor and the second outlet end connected at a location upstream of the separation vessel, said re-cycle line being surrounded by water, wherein, the coolant surrounding said flow line is seawater, and said flow line (12) has a length which is sufficiently long to ensure that said well stream fluid is cooled to a temperature equal to, or in the region of, the temperature of the seawater surrounding the flow line (12) such that the temperature of the well stream fluid when entering said separation vessel (16) is in the range of −2° C. to +4° C.

5. The subsea compression system of claim 1, further comprising a cooler (13) being fluidly connected to said flow line (12).

6. The subsea compression system of claim 4, wherein said flow line (12) has a length between 0.5 km and 5 km.

7. The subsea compression system of claim 1, wherein the re-cycle line is connected to the compressor outlet side at a take-off point, an export line is connected downstream of the take-off point, a cooler (40) is fluidly connected to the compressed gas stream at a location between the re-cycle line (24) take-off point and the export line, and a restrictor (36) with a scrubber (38) is fluidly connected to the compressed gas stream on the export line downstream of the cooler (40), whereby the compressed gas can be dew-point controlled prior to export.

8. A method for compressing a well stream fluid at a subsea location, comprising the steps of:

flowing hydrate inhibited well stream fluid in a flow line into a separation vessel, the flow line being cooled by water, wherein the well stream fluid entering said separation vessel has a temperature in the region of the temperature of the water surrounding the flow line;

separating the well stream fluid in the separation vessel in a separated gas stream;

compressing the separated gas stream in a compressor (18; 18', 18") to form compressed gas; and from an outlet side of the compressor, feeding compressed fluid due to surge or re-cycle, back to a location between said separation vessel (16) and an inlet side of the compressor (18; 18', 18").

9. The method of claim 8, wherein the temperature of the well stream fluid entering said separation vessel is in the range of −2° C. to +4° C., and further comprising, following separation, feeding the gas stream into a plurality of compressors (18', 18") connected in parallel, each compressor comprising separate re-cycle lines (24', 24") being fluidly connected at a respective first end to the compressed gas stream at the outlet side of the respective compressor (18', 18") and at a respective second end to the gas stream at a location between the separation vessel (16) and the inlet side of the respective compressor (18', 18").

10. The method of claim 8, further comprising cooling said compressed gas stream at a location between a take-off point of the re-cycle line (24) and the export line and dew-point controlling said compressed gas prior to export by means of a restrictor (36) with a scrubber (38) fluidly connected to the compressed gas stream between the cooler (40) and an export line.

11. A method for compressing a well stream fluid at a subsea location, comprising the steps of:

flowing hydrate inhibited well stream fluid in a flow line into a separation vessel, the flow line being cooled by water, wherein the well stream fluid has a temperature in the region of the temperature of the water surrounding the flow line;

separating the well stream fluid in the separation vessel in a separated gas stream;

compressing the separated gas stream in a compressor (18; 18', 18") to form compressed gas; and from an outlet side of the compressor, feeding compressed fluid due to surge or re-cycle, back to a location upstream of said separation vessel (16).

12. The method of claim 8, further comprising heat exchanging said compressed fluid being fed due to said surge or re-cycle, in order to control the temperature of said fluid.

13. The method of claim 12, further comprising heat exchanging said compressed fluid being fed due to said surge or re-cycle, in order to cool said fluid.

14. The method of claim 8, further comprising cooling said well stream to a temperature which is equal to, or in the region of, the temperature of the seawater surrounding the flow line (12), prior to its entry into said separator (16).

15. The method of claim 14, wherein said well stream is cooled by means of a heat exchanger fluidly connected to said flow line (12).

16. The method of claim 14, wherein said well stream is cooled by means said flow line (12) having a length between 0.5 km and 5 km.

17. The method of claim 11, wherein, following separation, feeding the gas stream into a plurality of compressors (18', 18") connected in parallel, each compressor comprising separate re-cycle lines (24', 24") being connected at a respective first end to the compressed gas stream at the outlet side of the respective compressor (18', 18") and at a respective second end to the well stream at a location upstream of the separation vessel (16).

18. The method of claim 11, further comprising cooling said compressed gas stream at a location between a take-off point of the re-cycle line (24) and the export line and dew-point controlling said compressed gas prior to export by means of a restrictor (36) with a scrubber (38) fluidly connected to the compressed gas stream between the cooler (40) and an export line.

19. The method of claim 11, wherein the temperature $t_{rec}$ of the re-cycled gas is controlled such that $t_{rec}$ is in the region of a temperature $t_{amb}$ of the water surrounding the recirculation line.

20. The method of claim 11, wherein said temperature is a temperature of the well stream fluid when entering said separation vessel (16) is in the range of −2° C. to +4° C.

21. The method of claim 8, wherein said temperature is a temperature in the region of the temperature of the water surrounding the flow line when the well stream fluid is flowed into the separation vessel (16).

22. The method of claim 8, wherein the well stream fluid is cooled by a cooler (13) fluidly connected to the flow line (12).

23. A subsea compression system, comprising:

a reservoir (10);

a separation vessel (16);

a flow line (12) connected to the reservoir (10) and to the separation vessel (16);

water surrounding the flow line;

a well stream fluid flowing through the flow line (12) from the reservoir (10) into a separation vessel (16), said well stream fluid being inhibited against hydrate formation and having a temperature higher than a temperature of the water surrounding the flow line so that said well stream fluid is cooled by the water surrounding the flow line down to at least the region of the temperature of the water, said well stream fluid being separated in the separation vessel into a separated gas stream, formation of hydrate being eliminated or reduced in the separated gas stream leaving the separation vessel and while within the system; and a compressor (18; 18', 18") connected to an outlet side of the separation vessel, the compressor receiving the separated gas stream from the outlet side of the separation vessel for subsequent compression of the separated gas stream into an export compressed gas stream.

24. The subsea compression system of claim 23, wherein, the water surrounding said flow line is seawater, and said flow line (12) has a length sufficiently long to ensure that said well stream fluid is cooled to the temperature equal to the temperature of the seawater surrounding the flow line (12) such that the temperature of the well stream fluid when entering said separation vessel (16) is in the range of −2° C. to +4° C.

25. The subsea compression system of claim 24, wherein said flow line (12) has a length between 0.5 km and 5 km.

26. The subsea compression system of claim 23, further comprising a further cooler (13) fluidly connected to said flow line (12).

27. The subsea compression system of claim 23, further comprising a re-cycle line having a first inlet end and a second outlet end, the first inlet end fluidly connected to the compressed gas stream at an outlet side of the compressor to received the compressed export gas stream at the outlet side of the compressor and the second outlet end fluidly connected intermediate the outlet side of the separation vessel and an inlet side of the compressor.

28. The subsea compression system of claim 23, further comprising a re-cycle line (24; 24', 24") having a first inlet end and a second outlet end, the first inlet end fluidly connected to an outlet side of the compressor to received the compressed export gas stream at the outlet side of the compressor and the second outlet end fluidly connected at a location upstream of an inlet side of the separation vessel.

29. The subsea compression system of claim 27, further comprising a re-cycle cooler fluidly connected to said re-cycle line.

30. The subsea compression system of claim 28, further comprising a re-cycle cooler fluidly connected to said re-cycle line.

* * * * *